US006755130B2

(12) United States Patent
Kersch et al.

(10) Patent No.: US 6,755,130 B2
(45) Date of Patent: Jun. 29, 2004

(54) CLEANING SYSTEM FOR A ROTARY PRESS AND METHOD OF CONTROLLING THE INTRODUCTION OF CLEANING FLUID

(75) Inventors: Andrea Kersch, Augsburg (DE); Ulrike Lütgens, Augsburg (DE); Wolfgang Zeller, Gersthofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/378,791

(22) Filed: Mar. 4, 2003

(65) Prior Publication Data

US 2003/0167949 A1 Sep. 11, 2003

(30) Foreign Application Priority Data

Mar. 6, 2002 (DE) ..... 102 09 856

(51) Int. Cl.[7] ..... B41F 1/66
(52) U.S. Cl. ..... 101/484; 101/424
(58) Field of Search ..... 101/484, 483, 101/424, 425, 423; 15/256.52, 256.51, 256.53; 134/18, 151

(56) References Cited

U.S. PATENT DOCUMENTS

| | | | | | |
|---|---|---|---|---|---|
| 4,686,902 | A | * | 8/1987 | Allain et al. | 101/424 |
| 5,005,478 | A | * | 4/1991 | Goldberg et al. | 101/425 |
| 5,114,596 | A | * | 5/1992 | Laterra | 210/798 |
| 5,213,044 | A | * | 5/1993 | Elia et al. | 101/483 |
| 5,367,982 | A | * | 11/1994 | DeMoore et al. | 118/46 |
| 5,402,724 | A | * | 4/1995 | Yaeso et al. | 101/424 |
| 5,797,328 | A | * | 8/1998 | Lippold et al. | 101/483 |
| 5,855,171 | A | * | 1/1999 | McManamon et al. | 101/364 |
| 5,967,044 | A | * | 10/1999 | Marschke | 101/363 |
| 6,012,391 | A | * | 1/2000 | Weishew | 101/424 |
| 6,575,096 | B1 | * | 6/2003 | Caruthers et al. | 101/491 |
| 2001/0035198 | A1 | * | 11/2001 | Carawan et al. | 134/18 |

FOREIGN PATENT DOCUMENTS

| | | |
|---|---|---|
| DE | 297 15 358 | 12/1997 |
| DE | 100 08 214 | 8/2001 |
| EP | 0 570 727 | 11/1993 |

OTHER PUBLICATIONS

Patent Abstracts of Japan, 05246020, Sep. 1993, "Washing Liquid Supply Device", Inventors: Sinya et al.

* cited by examiner

*Primary Examiner*—Anthony H. Nguyen
(74) *Attorney, Agent, or Firm*—Cohen, Pontani, Lieberman & Pavane

(57) ABSTRACT

An automatically controlled cleaning system has a cleaning fluid reservoir with a feed of the cleaning fluid to the rotating bodies to be cleaned via a cleaning element for each body. Its serviceability can be monitored, in particular erroneously exceeding the critical quantity of cleaning agent per unit time during the cleaning of the rotating bodies of the press can be detected and countermeasures can be initiated, by constructing the cleaning reservoir as a pressure container which can be pressurized from a compressed-air source via an electronically drivable changeover valve V1, and by implementing each feed of the cleaning fluid to the rotating body by means of a fluid feed line in which there are installed at least one electronically driveable changeover valve V4 that controls the flow, and at least one further electronically driveable changeover valve V5 which controls the expulsion quantities and expulsion times of the cleaning fluid. A pressure sensor 6 arranged between the changeover valves V4 and V5, measures the line pressure and outputs signals to the control means. At least all the electronically drivable changeover valves V1, V4, V5 can be switched by the control means on the basis of a determinable operating program and monitored by a monitoring program communicating with the latter and incorporating the signals supplied by the pressure sensor 6, and at least one shut-down measure can be derived via the control means on the basis of the control result.

10 Claims, 6 Drawing Sheets

CLEANING SYSTEM FOR A ROTARY PRESS AND METHOD OF CONTROLLING THE INTRODUCTION OF CLEANING FLUID

BACKGROUND OF THE INVENTION

1. Field of the Invention

The invention relates to a cleaning system for washing cylindrical surfaces of rotating bodies of a rotary printing press, such as printing-forme and rubber-blanket cylinders, impression cylinders, damping-solution or inking-unit rolls. The invention also relates to a method of controlling the introduction of cleaning fluid for a cleaning system for rotating bodies of a rotary printing press.

2. Description of the Related Art

During the printing of each edition, more or less severely disruptive dust, coating or fibrous constituents from the paper are, for example, deposited on the rubber blanket in the printing unit of a rotary press, or, together with paper fillers or loose paper fibers, the printing ink forms a layer, which have a considerable influence on the print quality resulting from such more or less severe build-up phenomena.

In the press, therefore, considerable quantities of organic solvents are still used, in particular for cleaning fluids. Quite specific hazards originate from the solvents, depending on the type of solvent, such as the risk of fire and explosion, but also risks to the health of the print shop staff.

At present there are two approaches to neutralizing the health hazards to the print shop staff. Firstly, the use of automatic cleaning systems and a detergent recycling system is normal nowadays. As a result of the use of automatic cleaning systems, the consumption of cleaning agent can be reduced considerably. Secondly, the replacement of the organic solvents by cleaning agents on a vegetable basis is intended. Cleaning agents made from vegetable oil do not meet all the desired requirements in an optimum way, at least at present.

The automatic cleaning system used nowadays comprises brush systems, washing-cloth systems, in particular towelling systems, and spraying systems. In the case of the towelling system, as a rule the towelling roll is cleaned by a doctor and wetted with clean detergent. In the washing-cloth and brush system, as is known the cleaning element is pressed against the cylinder or roll surface to be cleaned. In the washing-cloth system, during the washing period, the cloth is wound repeatedly onward from a clean-cloth roller to a dirty-cloth roller. The washing cloth or the brush and/or the cylinder surface are wetted with cleaning agent via a nozzle spraying device. In a spraying system, solvent and/or water is sprayed, for example, onto the rubber blanket or onto the cylinder surface to be washed. Printing ink and existing paper constituents begin to be separated and are then either doctored off or picked up by the washing device, for example by the washing cloth or the towelling roll, or picked up by the moving paper web. The small cross section of an automatic cleaning system on the spraying system, having a washing bar which is installed, for example, on the paper inlet side (but other positionings are also conceivable) permits installation even in the event of difficult space conditions.

As already outlined at the beginning, automatic cleaning systems in presses therefore use, as cleaning agents, fluids from which during operation, but in particular in the case of a fault in the cleaning system, a hazard to humans and system can originate. The main hazard in this case originates from the flammable cleaning agent which is used, which can come into contact with hot surfaces (for example in the dryer in the case of heatset inks). According to the prior art, therefore, the quantity of fluid per unit time is limited (below a determined critical quantity) in such a way that ignition of the mixture which forms after the liquid cleaning agent has changed to the gaseous state cannot take place.

In order to increase the machine safety of the cleaning system, the intention in addition is to prevent unintended emergence even of small quantities of the cleaning agent per unit time, that is to say the adjustment of the system is to be carried out in an optimum way with regard to the necessary quantity of cleaning agent, which is characterized by the actual spraying time. Here, it is not possible to make any concrete statements, since each machine and each system is different. In addition, the papers and cleaning agents used, including the solvents, have an influence on the washing operation. For this reason, as a rule appropriate trials have to be carried out in order to achieve the optimum results.

Because of the risk of ignition of the cleaning agent which, for example, can be given by transporting a supercritical quantity into the dryer of the press by means of the paper web, it must be possible to meter the feed of cleaning agent very accurately.

This requirement is currently met by so-called metering pumps, which are controlled from an operating panel. A critical precondition for the necessary success is therefore the correct adjustment of the system with regard to the requisite quantity of cleaning agent, which is characterized by the actual spraying time. The quantity of cleaning agent per unit time which is introduced into the press is therefore restricted below the respective critical value which is permitted for the dryer of the press with respect to the ignition capability of the cleaning agent. The parameters to be taken into account in this case are the composition of the cleaning agent and the dryer characteristics.

For example, EP 0 570 727 A1 describes a cleaning system for a rotary press which is constructed in such a way that it operates under automatic control, and the fluid expulsion quantities and fluid expulsion times of the spraying units can be adjusted individually and controlled automatically. In this case, the cleaning agent can in each case be sprayed by means of a nozzle bar directly onto the rotating press parts or onto a cleaning element such as a washing cloth, for example (see DE 100 08 214 A1) or brush roll. The nozzle bar or bars are connected via an intermediate reservoir and non-return valves, which open in a direction to the intermediate reservoir and close in the opposite direction, to fluid feed lines to which the cleaning agent can be fed in a precisely metered manner by a metering pump. The metering pumps are actuated by controlled valves. The metered quantity of fluid put into the intermediate reservoir in each case is then expelled through the nozzle bar by a compressed-air column and sprayed out. This cleaning system is suitable for the wet cleaning of rotating press parts such as blanket cylinder, conventional or digitally imaged (CTP) forme cylinder, impression cylinder, ink transfer rolls and so on of presses.

However, the use of metering pumps with regard to their ability to be placed locally in the system and the overall size, and also the necessity to use fluid feed lines of equal lengths, and the necessity for additional devices such as non-return valves, entails disadvantages caused by the principle. If it is wished to avoid fluid lines of unequal length or excessive length to supply a plurality of nozzle bars, then a separate metering pump will be needed for each nozzle bar and each type of fluid, so that for example in the case of two nozzle bars which each have to be supplied with two different fluids, four metering pumps are required. As a rule, metering pumps constitute costly special fabrications which occur in many variants in the whole of automation technology. Furthermore, complicated calibration activity is required. In particular, in the case of central supply, only individual calibrations are possible and many individual lines are required. A system incorporating metering pumps is certainly entirely robust with respect to a series of fault influences, but permits no conclusions about the serviceability of the plant.

SUMMARY OF THE INVENTION

On this basis, the invention is based on the object of developing an automatically controlled cleaning system of the type outlined at the beginning in such a way that its serviceability can be monitored, in particular erroneously exceeding the critical quantity of cleaning agent per unit time during the cleaning of the rotating elements of the press (leakage) can be detected and countermeasures can be initiated. Furthermore, this object is to be achieved with means which are simple in design terms and, as compared with metering pumps, are more cost-effective and give rise to no concern with respect to the risk of fire and explosion.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
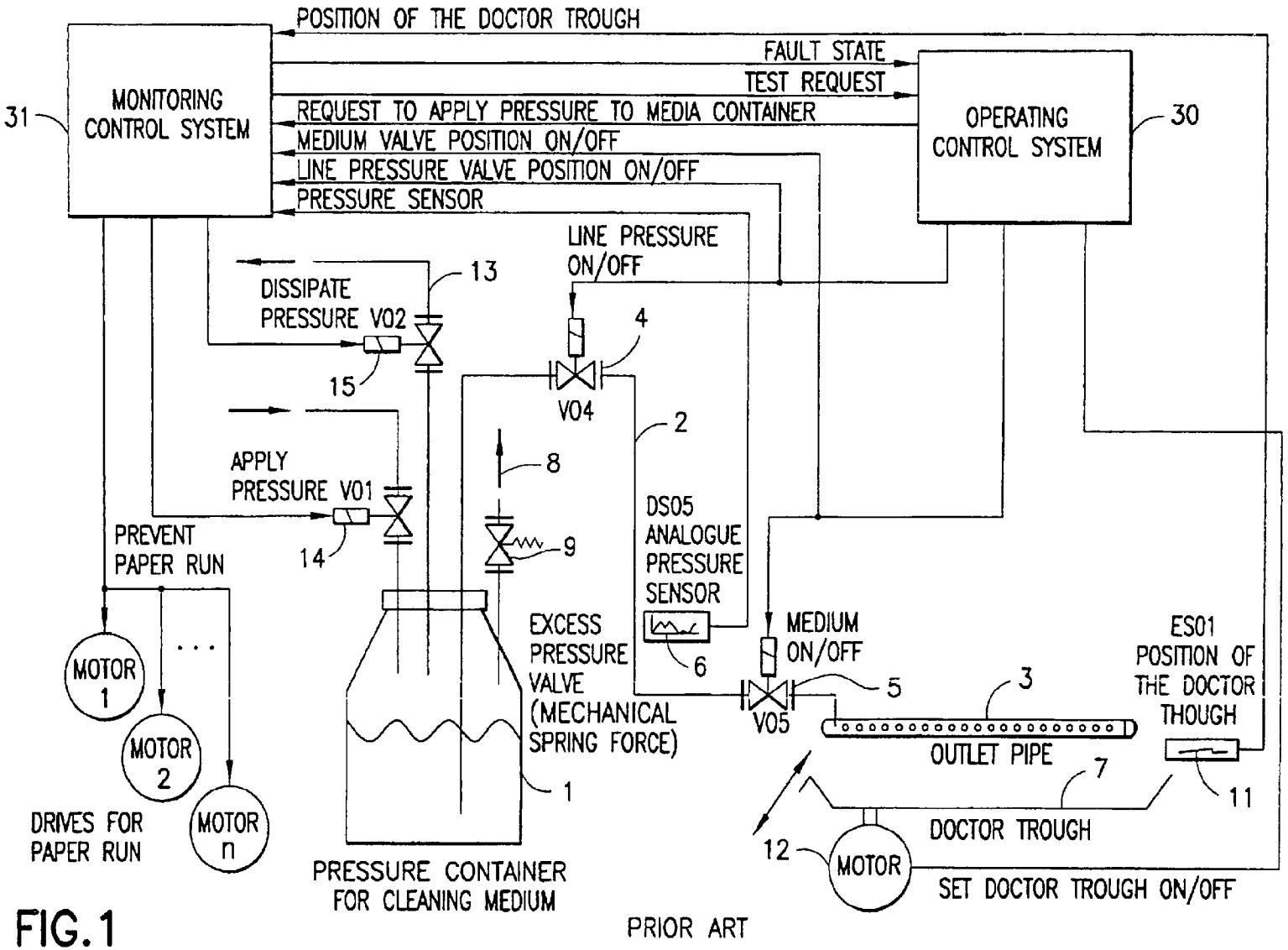
PRIOR ART FIG. 1
FIG. 1 shows a schematic illustration of a cleaning system according to the invention, by way of example in the form of an inking-unit washing device.

The cleaning system illustrated for a rotary press for washing inks and other contaminants of rotating bodies with a cleaning fluid comprises, possibly but not necessarily, a circulation system for the cleaning fluid, a cleaning fluid reservoir in the form of a storage container 1 which can be pressurized and in which cleaning fluid is stored, which in turn, by means of a feed in the form of at least one fluid feed line 2, can be brought to at least one cleaning element in the form of a nozzle bar 3.

The nozzle bar or bars 3 has or have a large number of nozzles, which are aimed at the associated rotating body, such as a forme cylinder, blanket cylinder, impression cylinder or an inking-unit roll, or at a cleaning element, such as a washing cloth. The nozzle bar 3 preferably extends over the entire printing or inking-unit width.

The return of the cleaning fluid from the nozzle bar 3 into a liquid store, not shown here, is carried out under the action of the force of gravity. Cleaning fluid doctored off the rotating body or cleaning element is collected in a collecting or doctor trough 7 at the start of the return. The doctor trough 7 can be monitored with regard to its position relative to the cleaning element 3 by means of a position sensor 11 arranged at the side. In the flow direction, the liquid feed line 2 contains a first electronically driveable changeover valve 4 (V4), a preferably analogue pressure sensor 6 to register the absolute pressure in the fluid feed line 2, and a second electronically driveable changeover valve 5 (V5). The changeover valves 4, 5 can in each case (digitally) assume a closed or open position. Here, closed position means that the valves do not let any fluid through, open position means that there is a passage for liquid. Furthermore, in the event of a fault, a safety valve 9, which is preferably loaded by a spring force, prevents the pressure in the pressure container 1 rising above a predefinable limiting value.

The pressure container 1 can be pressurized from a compressed-air source, not shown, generally from the existing supply system of the press, via an electronically driveable changeover valve 14 (V1), and can be relieved of pressure via a further pressure line 13 and an electronically driveable changeover valve 15 (V2) accommodated therein. In order to drive the changeover valves electronically and to read the analogue pressure sensor 6, and also the position sensor 11 of the collecting trough 7, electronic control means are provided which makes it possible for the expulsion quantities and the expulsion times of the cleaning fluid for the cleaning element 3 to be adjusted individually and controlled automatically by means of a determinable operating program and a monitoring program communicating with the latter, incorporating the signals supplied by the analogue pressure sensor 6. The wiring of the changeover valves 14 (V1) and 15 (V2) is carried out in such a way that when the changeover valve 14 (V1) is closed, the changeover valve 15 (V2) is open and vice versa.

In a preferred embodiment, the electronic control means comprise an operating control system 30 and a monitoring control system 31. The operating control system 30 is responsible for the digital control at least of the changeover valves V4 and V5 and driving the drive 12 of the doctor trough 7; the monitoring control system is used at least to drive the pressure container 1 via the changeover valves V1 and V2.

The proposal of the invention is therefore based on the principle of pressurizing a cleaning-agent container. By means of the control-means modules comprising operating control system 30 and monitoring control system 31, and using existing redundant sensors (for example position sensor 11) and actuators, pressure-based introduction of cleaning agent can be carried out and, respectively, as a result of supplementation by further sensors (pressure sensor 6) and actuators (valves V1, V4, V5), local self-diagnosis can be carried out, by which means faults on the changeover valves V1, V4, V5 or leakages in the feed line 2, at the pressure sensor 6 or faults in the return (position error of the collecting trough 7) can be indicated, and the initiation of suitable measures which counteract a possible hazard is possible. The proposal of the invention therefore additionally avoids the use of metering pumps.

The measures relating to fault detection indicate the serviceability of the system and, in the event of a fault, the location of a fault, which, in the sense of system diagnosis, is associated with advantages with regard to finding the cause of a fault and eliminating the fault.

It is evident that the electronic control means comprising operating control system 30 and monitoring control system 31 are interconnected via signal lines in such a way that all the actuators can be switched, all the sensors can be read and running sequences for switching operations of the operating program and of the monitoring program communicating with the operating program can be stored and executed. Operating and monitoring programs can be compiled from a central computer by transmitting program data via the transmission channel to the electronic control means of the cleaning system, which certainly permits the rapid and reliable adaptation to print jobs from the central computer or from the control desk of the press.

In the present exemplary embodiment, in each case via a signal line from the monitoring control system 31, the pressure sensor 6 and the position sensor 11 of the collecting trough 7 are read, and the position of at least the changeover valves V1, V4, V5 is monitored, and at least the signal lines from the changeover valves V4 and V5 lead to the operating control system 30.

The monitoring control system 31 and operating control system 30 communicate with each other via the monitoring and operating program in a procedure in which the changeover valves V1, V4, V5 are actuated in a sequential sequence that can be predefined by the operating program, after each sequence step the respective switching operation is assessed as a function of the signals output by the pressure sensor 6 with respect to the time relationship with the preceding switching operation, in the form of a desired-actual comparison, each assessment is compared with a fault state description implemented in the monitoring program and, depending on the comparison, either the sequential sequence for introducing the cleaning fluid is continued or, via the control means, a shut-down measure, such as stopping the drive of the paper transport or interrupting the feed of cleaning fluid to the cleaning element 3, is initiated, the fault states for the monitoring program preferably being described by means of the valve positions of the changeover valves V1, V4, V5 in conjunction with a pressure variation to be expected in the fluid feed line and the signals from the pressure sensor, that is to say a leakage in the fluid feed line and/or defective changeover valves V1, V4, V5 being detected by using the pressure/time variation in the respective fluid feed line 2.

This means that the monitoring control system 31 is given by the operating control system 30 the data relating to the requirement to pressurize the pressure container 1 (via the changeover valve V1), and the operating control system 30 receives the data relating to the fault state description from the monitoring control system 31.

Figure 2:
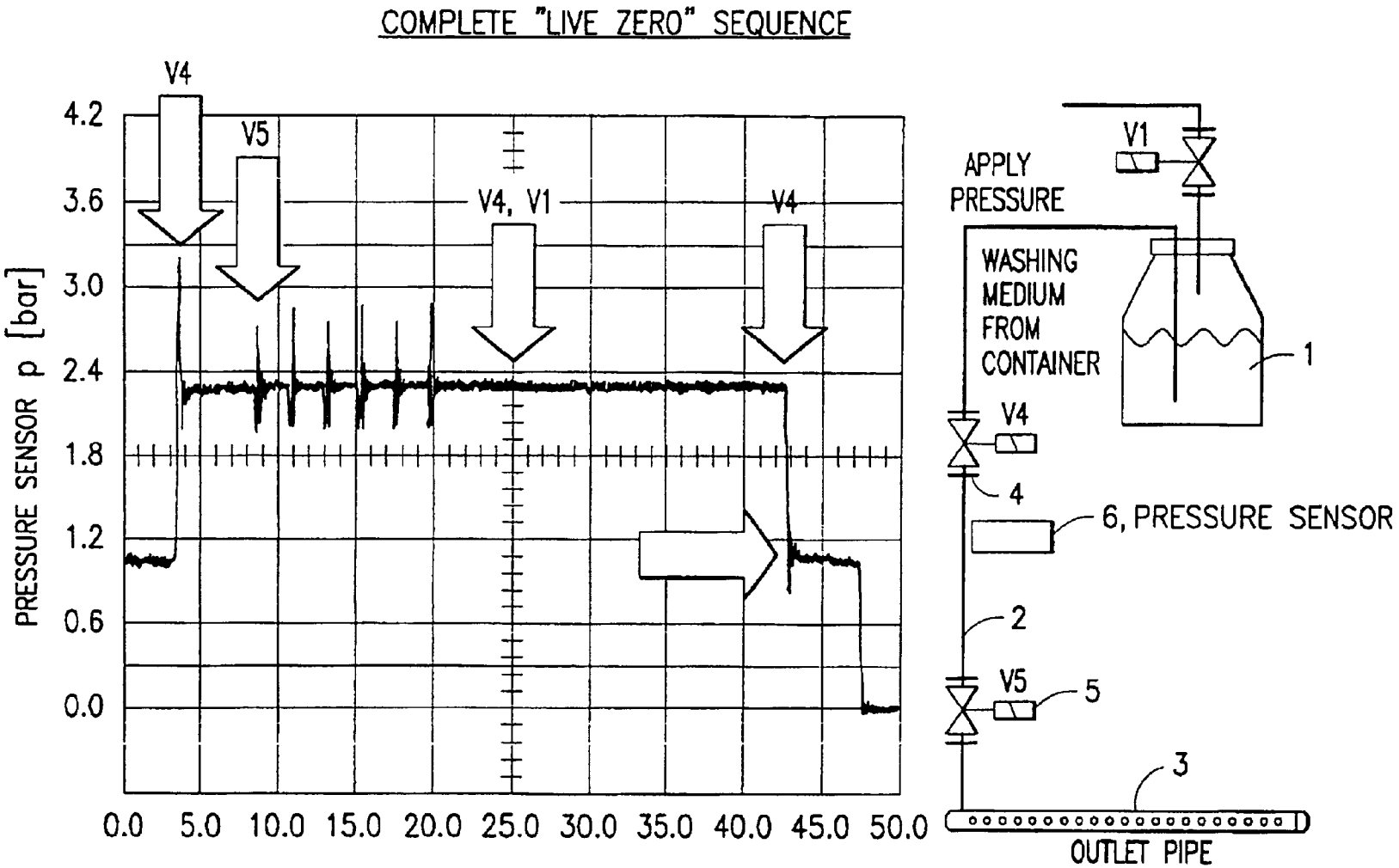
FIG. 2 shows the verification of an analogue pressure recording in the fluid feed line of the cleaning system according to the invention during a suitable sequential sequence of switching operations of the valves, FIGS. 3 to 5 in each case show a specific description of a fault as a function of the signals output by the pressure sensor.

In the graphic in FIG. 2, signals read out from the analogue pressure sensor 6 are plotted over a time interval of 50 seconds, and thus a complete sequence of the progress of the switching operations which is provided by the operating program. At the starting time, the pressure sensor 6 indicates an ambient pressure of about 1 bar. As soon as the changeover valve V4 is switched into the open position, the absolute pressure as the sum of the pressure of the pressure reservoir 1 and ambient pressure is present in the feed line 2. The changeover valve V5 controlling the expulsion quantities and expulsion times of the cleaning fluid is brought repeatedly briefly into the open position (in the present case, the valve V5 is actuated six times) and closed again. Following the closed position of the valves V4, V1, the pressure in the feed line 2 must remain constant in order to detect pressure-stable feed lines 2 and servicable (leakproof) changeover valves V4, V5 in the fault state description of the monitoring program. Only in the following open position of the valve V4 (V1 and V5 closed) is ambient pressure indicated again. If no pressure at all is indicated (in the last three seconds in the example of FIG. 2), it emerges from the fault state description that the analogue pressure sensor 6 is defective and must be replaced. An absolute pressure measurement of this type is designated a "live zero" in the specialist world.

Figure 3:
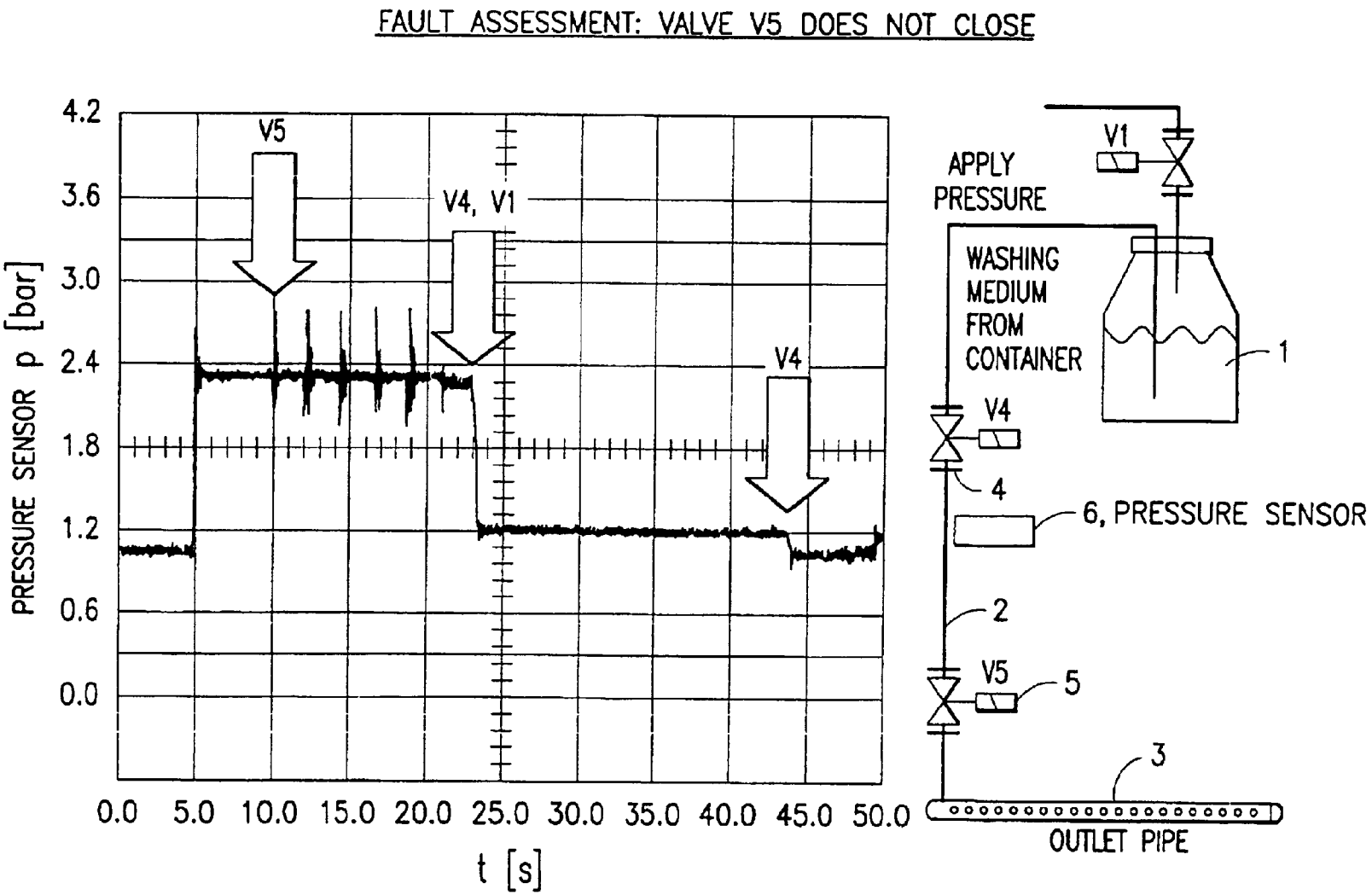

FIG. 3 shows the fault state description in the case of a defective changeover valve V5, in a maimer analogous to FIG. 2. According to the progress of the sequence according to FIG. 2, V4, V1 are closed following the spraying operation by means of V5, so that the pressure in the feed line 2 should actually remain constant as in FIG. 2. However, because of the pressure drop after about 24 seconds after the start of the sequence, the changeover valve V5 can be recognized as defective or it can be recognized that it no longer closes. After the valve V4 has been opened, the pressure returns completely to the ambient pressure.

Figure 4:
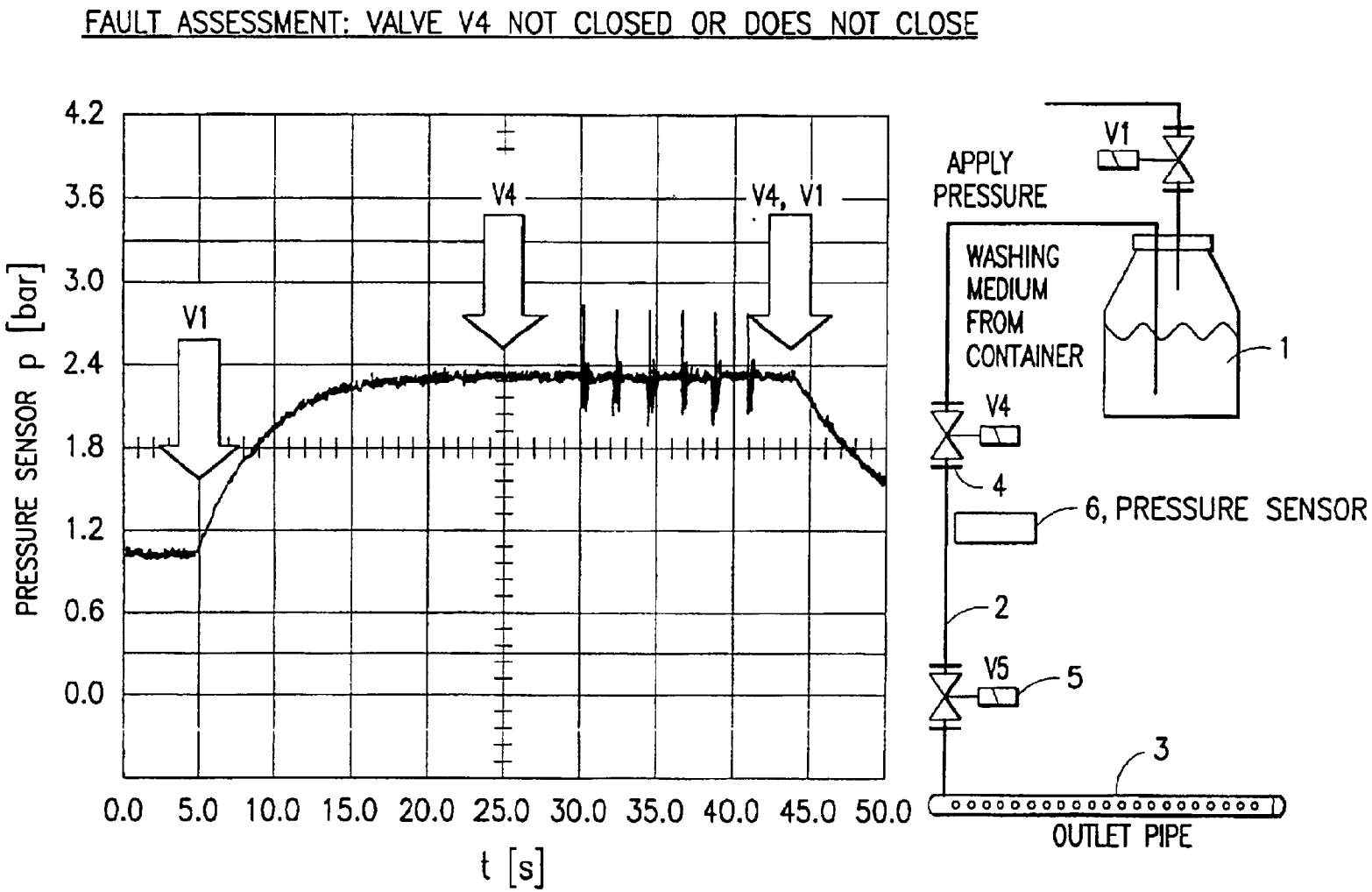

FIG. 4 shows the fault state description for a defective or erroneously unclosed valve V4, which is intended to control the flow through the feed line 2. The time variation of the sequential sequence, predefined by the operating program, of the actuation of the changeover valves V4, V5 is displaced, since the pressure in the feed line 2 is built up too early. In the closed position of the valves V4, V1, the pressure again does not remain constant, since the valve V4 erroneously just does not close.

Figure 5:
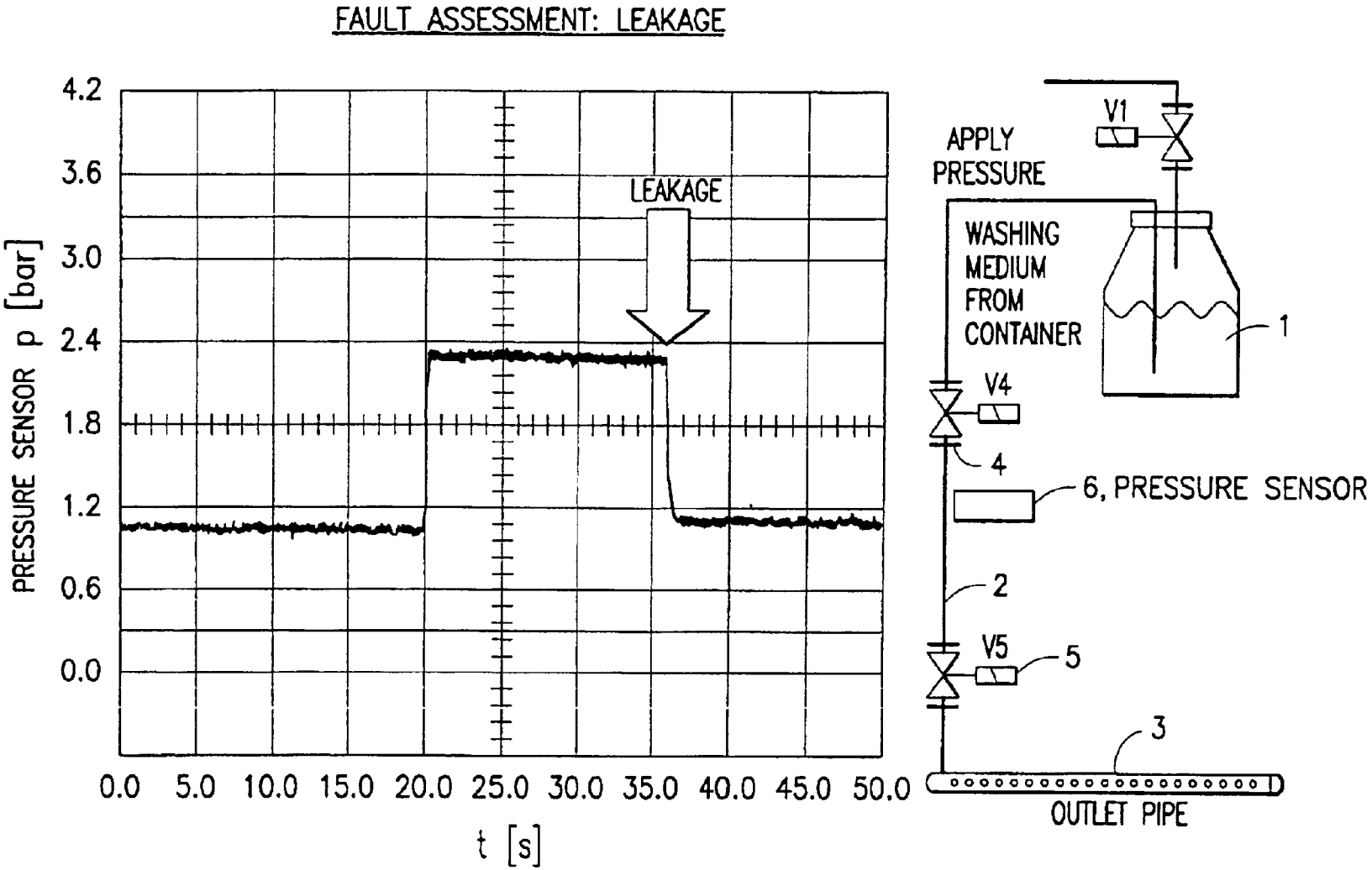

Finally, FIG. 5 shows the fault state description of a leak in the fluid feed line 2. With the pressure initially constant, this falls abruptly to the ambient pressure.

If such fault states described previously occur, measures for avoiding an uncontrolled emergence of cleaning fluid, in particular into the dryer of the press, must be initiated immediately. For this purpose, at least one shut-down measure can be derived via the control means. In the exemplary embodiment according to FIG. 1, signal lines lead from the monitoring control system 31 to the drives (motor 1 to n) of the paper run. As a result, the paper run can be switched off or it is possible to interlock the paper run and the supply with cleaning fluid (by closing the valves V1 and/or V4 and/or V5). This means that in the operating program it is possible to implement the condition that the paper run can be started only after the fault-free functioning of the cleaning system.

This structure of a cleaning system, if applied to a plurality of rotating bodies to be cleaned, permits the appropriate branching of the feed lines 2 on site. For each feed line 2, therefore, two changeover valves V4, V5 are provided in series, and a pressure sensor 6 located between them and measuring the absolute pressure in the feed line 2. Via the electronic control means 30, 31, as a result of knowledge of the respective closed and open positions of the valves V1, V4, V5, the desired pressure to be expected in the feed line 2 can be determined and, on the basis of the signals from the pressure sensor 6, a fault state description can be derived, so that continuous fault monitoring becomes possible.

Considered in Summary:

The proposal of the invention, by using the fault detection measures and fault reactions, permits the introduction of cleaning agent from two different points of view, which differ with regard to the time requirements on the mechanisms for fault detection and fault reactions. In addition to monitoring the proper operating sequence in accordance with the following alternatives, monitoring for faults and the prevention of the unexpected start-up of the system for introducing the cleaning agent are fundamentally carried out.

In the event of the cleaning agent being introduced with the paper web at a standstill, it is recognized as a fault that stopping the introduction of cleaning agent necessitated by an operating, component, connection or control fault has not been carried out. This is followed by the automatic initiation of a suitable fault reaction (for example preventing the restarting of the paper web transport and/or deactivating the cleaning agent supply).

In the event of the cleaning agent being introduced with the paper web running, it is recognized as a fault that the critical quantity of cleaning agent per unit time has been exceeded. This is followed by automatic introduction of a suitable fault reaction (for example preventing the paper web transport and/or deactivating the cleaning agent supply).

To introduce cleaning agent according to the invention, actuators are actuated in a sequential sequence and, following each step in this sequence, the proper effect of the switching operations (switching variables) is assessed by using measured or derived variables (assessment variables) in the time relationship.

The expectation of the monitoring system can in this case relate both to the non-changing of the assessment variable and to a describable change in the assessment variable (for example relative change, absolute change) in order to obtain the fault state. The expectation with regard to the assessment variable in this case already takes account of changes in the switching variables carried out in the past, even in different actuators, and includes these in the assessment.

In this case, a suitable configuration of the sequential sequence for the introduction of cleaning agent into the press, and also ending the introduction, permits complete monitoring of the system with regard to the occurrence of an error. If no change occurs in a switching variable, then the assessment variable is monitored to the maintenance of the current value (no emergence of cleaning agent possible) or the time duration in which it remains in this step in the sequential sequence (determination of the quantity of cleaning agent per unit time).

In order to ensure an effective fault reaction precisely in the event of any fault, at least one shut-down path is necessary, which is not within the active range of the operational control system and which is driven as a function of the result of the fault monitoring.

If the system is in a step in the sequential sequence without a switching command having been provided according to the operation, then the mechanism of the fault monitoring can initiate a sequential sequence of test steps without there being any introduction of cleaning agent into the press. This sequence of test steps is provided when no change takes place in a switching variable over a period which is longer than a period which allows the occurrence of a second fault to be probable. By means of this forcible dynamisation measure, a fault which may occur but has previously been unrecognized is discovered before the occurrence of a further fault can lead to a loss of safety.

According to the invention, the construction of a fluid feed line 2 comprises at least one electronically drivable changeover valve V4 that controls the flow, and at least one electronically drivable changeover valve V5 which controls the expulsion quantity and expulsion times of the cleaning fluid, and also at least one pressure sensor 6 measuring the line pressure between the valves V4, V5. Within the scope of the invention, "at least" means that, apart from one, a plurality of cleaning elements 3 can be supplied with cleaning fluid via in each case one or else via a branched feed line 2 in an individual or parallel connection.

Figure 6:
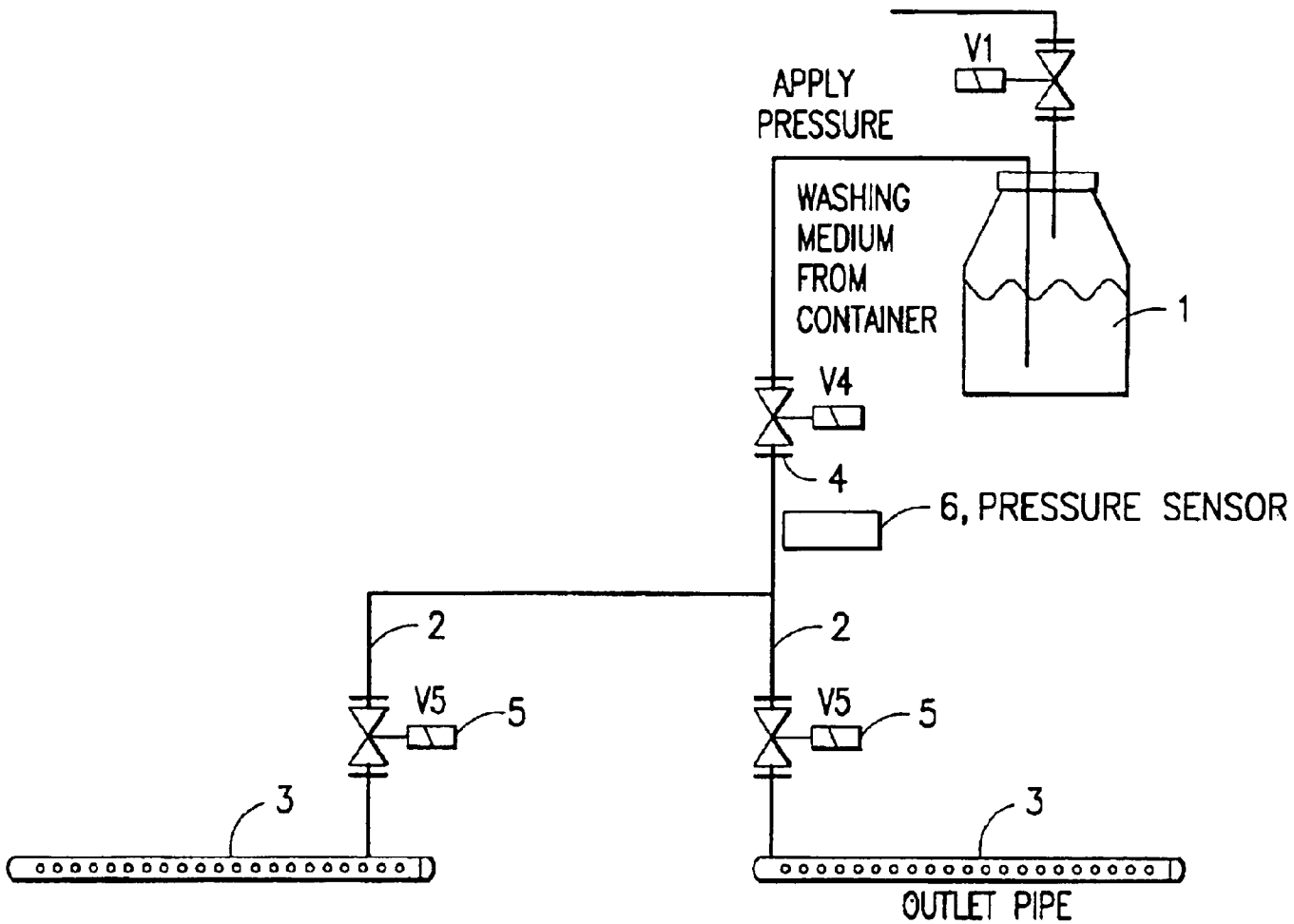
FIG. 6 shows the feeding of cleaning fluid for a plurality of cleaning elements.

FIG. 6 shows, by way of example, a supply of a plurality of cleaning elements 3 (two in the present case) for different roles and/or cylinders in a rotary press in the form of a parallel connection, that is to say a branching of a fluid feed line 2 downstream of the changeover valve V4 in the flow direction, so that in the present case, for a requirement described above for a fluid feed line 2, the number of necessary pressure sensors 6 can turn out to be less than the number of cleaning elements 3 or changeover valves V5.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A cleaning system which utilizes a cleaning fluid to wash ink and contaminants off of rotating bodies in a rotary printing press, said cleaning system comprising:

a cleaning element adjacent to each rotating body;

a cleaning fluid reservoir constructed as a pressure container which can be pressurized from a compressed air source;

an electronically drivable changeover valve which controls the supply of compressed air to said pressure container;

a fluid feed line connecting said pressure container to each said cleaning element;

an electronically drivable changeover valve in each said feed line that controls the flow of fluid;

an electronically drivable changeover valve in each said feed line that controls the expulsion quantities and expulsion times of cleaning fluid;

a pressure sensor between said changeover valves in each said feed line, which sensor measures the line pressure and outputs signals;

an operating control system which controls said changeover valves in each said fluid feed line; and a monitoring control system which communicates with said operating control system and receives said signals from said pressure sensor, said monitoring control system being able to initiate at least one shut-down measure of the printing press based on said signals.

2. A cleaning system as in claim 1 wherein said pressure sensor operates in an analogue manner which measures an absolute pressure comprising ambient pressure and line pressure.

3. A cleaning system as in claim 1 wherein said cleaning element is a spraying system comprising a washing bar installed in one of a printing unit and an inking unit of the rotary printing press.

4. A cleaning system as in claim 1 wherein said at least one shut-down measure comprises electronically driving at least one motor of a paper transport system.

5. A cleaning system as in claim 1 wherein said at least one shut-down measure comprises electronically driving said changeover valve which controls the supply of compressed air to said pressure container to interrupt the pressurization of said pressure container.

6. A cleaning system as in claim 1 wherein said fluid feed line comprises a plurality of branches for supplying cleaning fluid to a respective plurality of cleaning elements, each said branch being downstream of said changeover valve that controls the flow of fluid and the pressure sensor, said system comprising a changeover valve in each said branch for individually adjusting the expulsion quantities and expulsion times of cleaning fluid in each said cleaning element.

7. A method for introducing cleaning fluid in a cleaning system which utilizes a cleaning fluid to wash ink and contaminants off of rotating bodies in a rotary printing press, said cleaning system comprising a cleaning element adjacent to each rotating body, a cleaning fluid reservoir constructed as a pressure container which can be pressurized from a compressed air source, an electronically drivable changeover valve which controls the supply of compressed air to said pressure container, a fluid feed line connecting said pressure container to each said cleaning element, an electronically drivable changeover valve in each said feed line that controls the flow of fluid, an electronically drivable changeover valve in each said feed line that controls the expulsion quantities and expulsion times of cleaning fluid, a pressure sensor between said changeover valves in each said feed line, which sensor measures the line pressure and outputs signals, an operating control system which controls said changeover valves in each said fluid feed line, and a monitoring control system which communicates with said operating control system and receives said signals from said pressure sensor, said monitoring control system being able to initiate at least one shut-down measure of the printing press based on said signals, said method comprising:

switching said changeover valves in a sequence which is predefined by said operating control system in order to introduce fluid into said at least one cleaning element;

assessing the operation of the system after each valve is switched by comparing the measured pressure value with a desired pressure value in the monitoring system;

comparing each assessment with a fault state description implemented in the monitoring system; and one of continuing the switching sequence and initiating a shut-down measure.

8. A method as in claim 7 wherein each said fault state description is described by means of the positions of the changeover valves in conjunction with an expected pressure variation over time in the fluid feed line and the signals from the pressure sensor.

9. A method as in claim 7 further comprising monitoring the serviceability of the pressure sensor.

10. A method as in claim 7 further comprising:

monitoring the position of a collecting trough with respect to the cleaning element and transmitting a position signal to the monitoring system; and in the event of a fault, interrupting at least one the paper transport and the feed of cleaning fluid to the cleaning element.

* * * * *